US009634384B2

(12) United States Patent
Shibahara et al.

(10) Patent No.: US 9,634,384 B2
(45) Date of Patent: Apr. 25, 2017

(54) CHIP ANTENNA AND MANUFACTURING METHOD THEREOF

(75) Inventors: Katsuo Shibahara, Kuwana (JP); Natsuhiko Mori, Kuwana (JP); Tatsuya Hayashi, Kuwana (JP)

(73) Assignee: NTN CORPORATION, Osaka (JP)

( * ) Notice: Subject to any disclaimer, the term of this patent is extended or adjusted under 35 U.S.C. 154(b) by 682 days.

(21) Appl. No.: 13/876,219

(22) PCT Filed: Sep. 2, 2011

(86) PCT No.: PCT/JP2011/070069

§ 371 (c)(1),
(2), (4) Date: Apr. 5, 2013

(87) PCT Pub. No.: WO2012/043144

PCT Pub. Date: Apr. 5, 2012

(65) Prior Publication Data

US 2013/0207849 A1 Aug. 15, 2013

(30) Foreign Application Priority Data

Sep. 28, 2010 (JP) ..... 2010-217021

(51) Int. Cl.
*H01Q 1/38* (2006.01)
*H01Q 9/42* (2006.01)
*H01P 11/00* (2006.01)

(52) U.S. Cl.
CPC ..... *H01Q 1/38* (2013.01); *H01P 11/00* (2013.01); *H01Q 9/42* (2013.01); *Y10T 29/49016* (2015.01)

(58) Field of Classification Search
CPC ..... H01Q 1/38; H01Q 9/42
USPC ..... 343/700 MS, 702
See application file for complete search history.

(56) References Cited

U.S. PATENT DOCUMENTS 6,292,139 B1 * 9/2001 Yamamoto ..... H01F 41/046 257/E23.061
2002/0027530 A1 * 3/2002 Tomomatsu ..... H01Q 1/362 343/895
2007/0216580 A1 * 9/2007 Lin ..... H01Q 1/243 343/702

(Continued)

FOREIGN PATENT DOCUMENTS

JP 10-242734 9/1998
JP 2003-78322 3/2003

(Continued)

OTHER PUBLICATIONS

International Search Report issued Nov. 29, 2011 in International (PCT) Application No. PCT/JP2011/070069.

(Continued)

*Primary Examiner* — Dieu H Duong
(74) *Attorney, Agent, or Firm* — Wenderoth, Lind & Ponack, L.L.P.

(57) ABSTRACT

After a three-dimensional antenna pattern (10) is formed by bending a conductive plate, the three-dimensional antenna pattern (10) thus bent is supplied in an injection molding die set as an insert component and a base (20) is formed by injection molding of a resin. With this, a chip antenna (1) comprising the three-dimensional antenna pattern (10) can be formed easier as comparison to a case where the antenna pattern is formed over a plurality of surfaces by printing and the like.

20 Claims, 6 Drawing Sheets

(56) References Cited

U.S. PATENT DOCUMENTS

| | | | | |
|---|---|---|---|---|
| 2009/0039168 | A1* | 2/2009 | Sakurai | G06K 19/07749 235/492 |
| 2009/0051616 | A1 | 2/2009 | Hong et al. | |
| 2011/0140987 | A1* | 6/2011 | Ito | H01Q 1/243 343/893 |

FOREIGN PATENT DOCUMENTS

| | | | | |
|---|---|---|---|---|
| JP | 2003-198230 | | 7/2003 | |
| JP | 2005-080229 | | 3/2005 | |
| JP | 2008-252272 | | 10/2008 | |
| JP | 2009-49992 | | 3/2009 | |
| JP | 2009-177661 | | 8/2009 | |
| JP | WO 2010018877 | A1 * | 2/2010 | H01Q 1/243 |
| JP | 2010-147860 | | 7/2010 | |

OTHER PUBLICATIONS

International Preliminary Report on Patentability and Written Opinion of the International Searching Authority issued Apr. 25, 2013 in International (PCT) Application No. PCT/JP2011/070069.

Chinese Office Action issued Apr. 22, 2014 in corresponding Chinese Patent Application No. 201180046510.7 with English translation.

* cited by examiner

CHIP ANTENNA AND MANUFACTURING METHOD THEREOF

TECHNICAL FIELD

The present invention relates to a board mount type antenna (chip antenna) to be incorporated into wireless communication devices such as a mobile phone, a wireless LAN, a Bluetooth (trademark) device, and the like.

BACKGROUND ART

The chip antenna includes a base formed of a dielectric body such as a resin and ceramics and provided with an antenna pattern formed of a conductor. As a method of forming the antenna pattern on a surface of the base, there have been employed printing, deposition, lamination, plating (refer to Patent Literature 1), etching (refer to Patent Literature 2), and the like.

CITATION LIST

Patent Literature 1: JP 10-242734 A
Patent Literature 2: JP 2005-80229 A

SUMMARY OF INVENTION

Technical Problems

As mobile phones and the like are downsized and become thinner, a demand for downsizing of chip antennae has become much higher. For example, when the antenna pattern is formed into a three-dimensional shape over a plurality of surfaces of the base, the conductor can be formed to cover a larger area. With this, the chip antenna can be downsized as compared, for example, to a case where the same antenna pattern is formed in a single plane.

However, an operation of forming the antenna pattern over the plurality of surfaces of the base by means such as printing is not easy. In particular, the chip antenna, which is to be incorporated in the mobile phone and the like, is required to be downsized to have a longitudinal side of 10 mm or less, or 5 mm or less in some cases. It is significantly difficult to form the antenna pattern over a plurality of surfaces of such a small chip antenna by printing and the like, which involves an increase in manufacturing cost and deterioration in productivity.

It is therefore an object of the present invention to manufacture a chip antenna comprising the three-dimensional antenna pattern easily and at low cost.

Solution to Problem

In order to achieve the above-mentioned object, according to the present invention, there is provided a manufacturing method for a chip antenna, the chip antenna comprising: a base made of a resin; and a three-dimensional antenna pattern formed of a conductive plate, the manufacturing method for the chip antenna comprising: a bending pressing step of bending the conductive plate so that the three-dimensional antenna pattern is formed; and an injection molding step of injection molding the base with the resin together with the three-dimensional antenna pattern as an insert component.

In this way, in the present invention, after the three-dimensional antenna pattern is formed by bending the conductive plate through the pressing process, the base is formed by injection molding of the resin together with the three-dimensional antenna pattern thus bent as an insert component. With this, the chip antenna comprising the three-dimensional antenna pattern can be formed easier as comparison to a case where the antenna pattern is formed over the plurality of surfaces by printing and the like.

When the conductive plate comprises a long-belt-like hoop member and the three-dimensional antenna pattern comprises a plurality of three-dimensional antenna patterns formed in the long-belt-like hoop member, the conductive plate can be successively supplied into a die set used in the bending pressing step (bending pressing die set) and a die set used in the injection molding step (injection molding die set). With this, as comparison, for example, to a case where conductive plates are supplied one by one into the die set for each shot of injection molding, the conductive plate can be supplied into the die set easier.

Specifically, for example, the three-dimensional antenna pattern may be formed as follows: punching out the long-belt-like hoop member so that a two-dimensionally expanded form of each of the plurality of three-dimensional antenna patterns is formed; shifting the two-dimensionally expanded form to the bending pressing step; and bending the two-dimensionally expanded form under a state in which the two-dimensionally expanded form remains fixed to the long-belt-like hoop member. Further, the injection molding of the base may be performed under a state in which the plurality of three-dimensional antenna patterns are arranged in the injection molding die set while being fixed to the long-belt-like hoop member. Note that, after the injection molding step, the chip antenna thus formed may be rolled up together with the long-belt-like hoop member, or may be cut off from the long-belt-like hoop member.

In a case where the antenna pattern is provided over the surfaces of the base, when there is a gap between the injection molding die set and the antenna pattern supplied as an insert component into the injection molding die set, the resin may enter the gap. Specifically, as illustrated, for example, in FIG. 10, when an angle $\theta 1$ of a bent portion of an antenna pattern 101 is lower than an angle $\theta 2$ at apart corresponding to the bent portion in an injection molding die set 102 ($\theta 1<\theta 2$), a gap P may be formed between the antenna pattern 101 and the injection molding die set 102. As a countermeasure, as illustrated in FIGS. 11*a* and 11*b*, an angle $\theta 1'$ of the bent portion of the antenna pattern 101 to be bent in the bending pressing step is set to be higher than the angle $\theta 2$ at the part corresponding to the bent portion in the injection molding die set 102 ($\theta 1'>\theta 2$). With this, the bent portion of the antenna pattern 101 is pressed by clamping of the die set 102, and hence the angle is corrected ($\theta 1=\theta 2$). As a result, the antenna pattern 101 and the injection molding die set 102 are held in close contact with each other, to thereby close the gap between the antenna pattern and the injection molding die set.

When the bending pressing step is performed by utilizing a force of the clamping of the injection molding die set for the base, it is unnecessary to provide an additional drive apparatus for bending the conductive plate. As a result, both equipment costs and equipment spaces can be reduced. In this case, the clamping of the injection molding die set for the base and the bending pressing step can be simultaneously performed.

For example, when the conductive plate is bent in two phases, or in order to further bend the conductive plate after the conductive plate is bent by utilizing the force of the clamping of the injection molding die set, the bending pressing step may be performed not only with the force of the clamping of the injection molding die set but also with a force of an additionally provided actuator. This actuator may be provided in or out of the die set for performing the bending pressing.

A chip antenna, which can be provided by the manufacturing method for a chip antenna described above, comprises: an antenna pattern formed of a conductive plate bent into a three-dimensional shape; and the base formed by injection molding of a resin together with the three-dimensional antenna pattern as an insert component.

In this case, when the antenna pattern is held by the base so that the three-dimensional shape is maintained, characteristics of the chip antenna can be stabilized. For example, in the case where the antenna pattern is provided over the surfaces of the base, when the angle of the bent portion of the antenna pattern becomes higher by an elastic force, two flat plate portions on both sides of the bent portion may be separated from the base. As a countermeasure, both the two flat plate portions on both the sides of the bent portion of the antenna pattern are held by being embedded in the base. In this way, the angle of the bent portion is prevented from becoming higher, and hence the three-dimensional shape of the antenna pattern can be maintained. Further, when the antenna pattern further comprises an edge portion provided with a projecting portion which is embedded in the base, the projecting portion yields an anchoring effect. With this, the antenna pattern and the base are more firmly coupled to each other, and hence the three-dimensional shape of the antenna pattern is more reliably maintained.

Alternatively, also when the three-dimensional antenna pattern is embedded in the base, the three-dimensional shape of the antenna pattern can be maintained.

It is preferred that the resin of the base comprise a highly dielectric material having a dielectric constant of 4 or more.

Further, in order to secure a bonding force between the conductive plate and the base, it is preferred that a surface roughness of at least a surface of the conductive plate, which bonded to the base, be Ra 1.6 or more.

Advantageous Effects of Invention

As described above, according to the present invention, the base is formed by injection molding together with the three-dimensionally bent antenna pattern as an insert component. In this way, the chip antenna comprising the three-dimensional antenna pattern can be manufactured easily and at low cost.

DESCRIPTION OF EMBODIMENTS

In the following, description is made of embodiments of the present invention with reference to the drawings.

Figure 1:
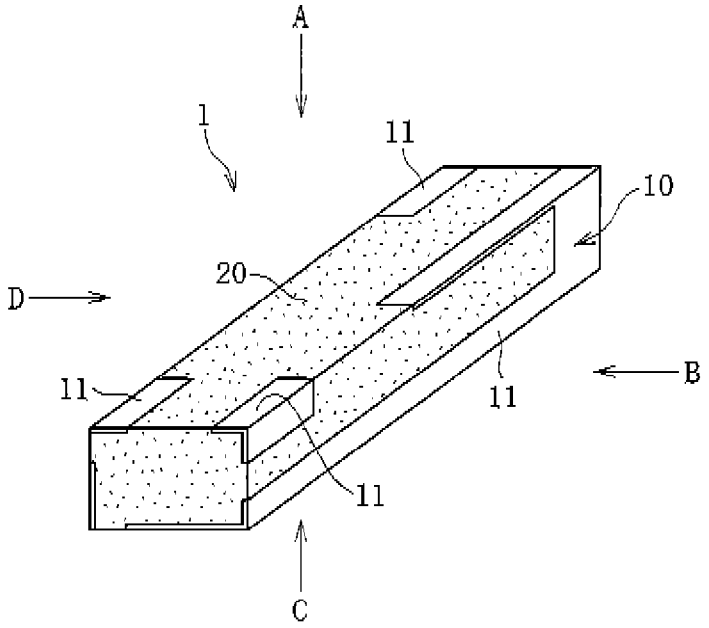
FIG. 1 A perspective view of a chip antenna according to an embodiment of the present invention.
Figure 2:
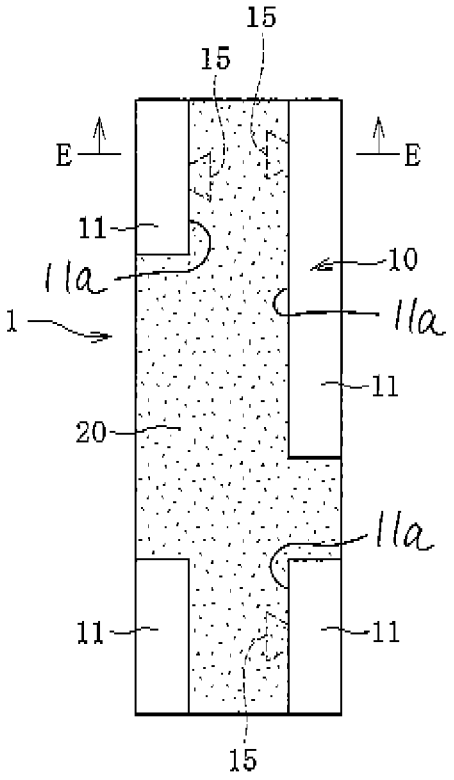
FIG. 2 A plan view in which the chip antenna of FIG. 1 is viewed in a direction A.
Figure 3:
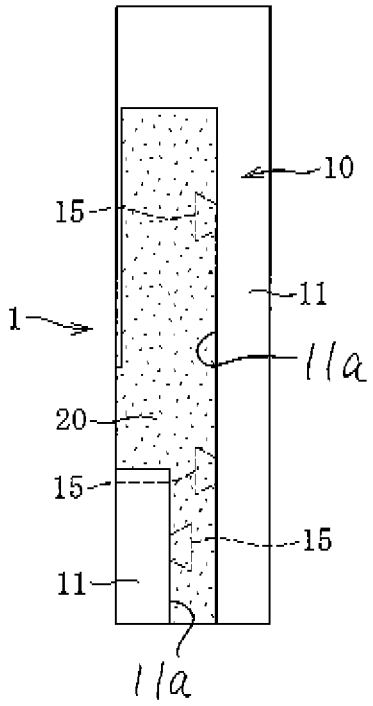
FIG. 3 A side view in which the chip antenna of FIG. 1 is viewed in a direction B.
Figure 4:
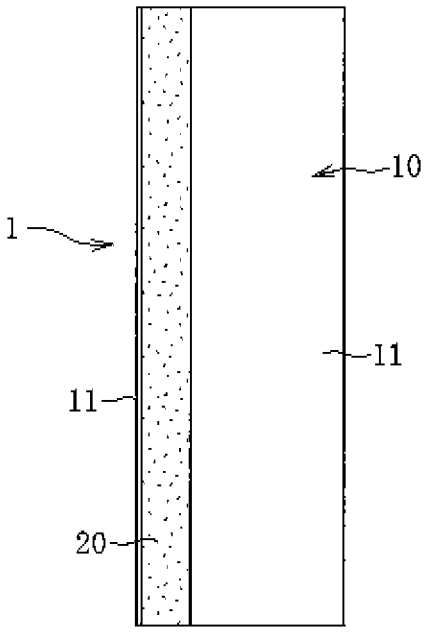
FIG. 4 A plan view in which the chip antenna of FIG. 1 is viewed in a direction C.
Figure 5:
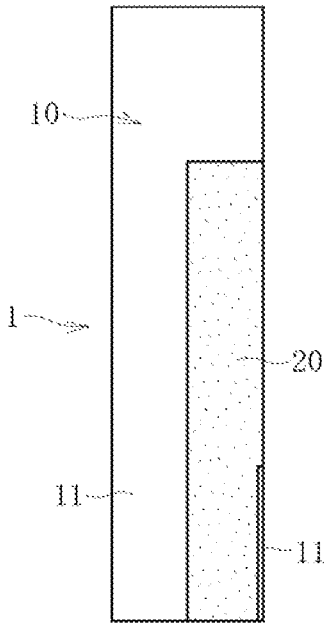
FIG. 5 A side view in which the chip antenna of FIG. 1 is viewed in a direction D.

A chip antenna 1 according to an embodiment of the present invention comprises, as illustrated in FIG. 1, a three-dimensional antenna pattern 10 formed of a conductive plate and a base 20 made of a resin, and exhibits a substantially rectangular parallelepiped shape as a whole. The base 20 is formed by injection molding of a resin together with the antenna pattern 10 as an insert component. In this way, the antenna pattern 10 and the base 20 are formed integrally with each other. A longitudinal length of the chip antenna 1 ranges, for example, approximately from 3 mm to 10 mm, and an upper surface of FIG. 1 constitutes a surface to be fixed to a board. Note that, in FIGS. 1 to 5, the base 20 made of a resin is indicated by a dotted pattern.

The antenna pattern 10 is formed of a conductive plate such as a metal plate, more specifically, a copper plate, a steel plate, a SUS plate, brass plate, and the like. Note that, when necessary, plating (for example, gold plating) may be performed on those metal plates. The conductive plate has a thickness set sufficiently to maintain the conductive plate in a three-dimensionally bent state, for example, set approximately to from 0.2 mm to 0.8 mm. The antenna pattern 10 is provided over surfaces of the base 20. In the illustration, the antenna pattern 10 comprises a plurality of conductive plates 11 provided separately from each other at a plurality of points on the surfaces of the base 20. In order to maintain fitting properties with respect to the base 20, at least a surface of the antenna pattern 10, which is bonded to the base 20, is preferred to be rough to some extent. For example, a surface roughness is set to Ra 1.6 or more, preferably Ra 3.2 or more.

Figure 6:
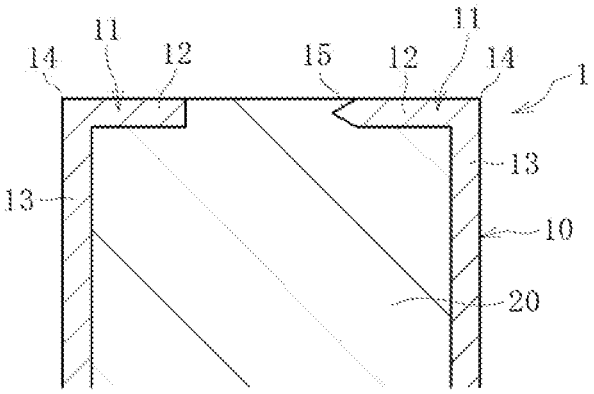
FIG. 6 A sectional view taken along the line E-E of the chip antenna of FIG. 2.

The antenna pattern 10 is formed by bending the conductive plates 11 into a three-dimensional shape so as to be provided over the plurality of side surfaces of the base 20 (refer to FIGS. 1 to 5). The antenna pattern 10 is held by the base 20, and hence the three-dimensional shape of the antenna pattern 10 is maintained. Specifically, as illustrated in FIG. 6, flat plate portions 12 and 13 on both sides of each of bent portions 14 are each embedded in the surface of the base 20. In the illustration, the entire antenna pattern 10 is embedded in the surfaces of the base 20. Further, the antenna pattern 10 comprises edge portions 11*a* provided with projecting portions 15 (refer to FIGS. 2 and 3), and the projecting portions 15 are embedded in the base 20 (refer to FIG. 6). In this way, the antenna pattern 10 in the bent shape is reliably held by the base 20. Thus, the flat plate portions 12 and 13 do not rise with respect to the base 20, and hence the three-dimensional shape of the antenna pattern 10 (angles of the bent portions 14) can be reliably maintained. Note that, it is not necessary to provide the projecting portions 15, and the projecting portions 15 may be omitted when the fitting properties of the antenna pattern 10 and the base 20 with respect to each other can be sufficiently secured.

A part of the antenna pattern 10 functions as a feeder terminal portion. The feeder terminal portion is connected to a feeder line (not shown), and serves as a terminal for feeding power to the antenna pattern 10. Further, another part of the antenna pattern 10 functions as a fixation portion. In order to fix the chip antenna 1 onto the board (not shown), the fixation portion and the board are, for example, soldered to each other.

The base 20 is a product formed by injection molding of a resin together with the antenna pattern 10 as an insert component. In the illustration, the surfaces of the base 20 and the surfaces of the antenna pattern 10 are flush with each other. The base 20 is made, for example, of a resin having a dielectric constant of 4 or more. Specifically, as a base resin, there may be employed polyphenylene sulfide (PPS), liquid crystal polymer (LCP), and the like. Further, a filler to be mixed with the resin is not particularly limited, and may comprise ceramics and the like. Note that, the resin having a dielectric constant of 4 or more is not necessarily limited to a base resin having a dielectric constant of 4 or more, and comprises a resin mixed with a filler and hence having a total dielectric constant of 4 or more.

Next, description is made of a manufacturing method for the chip antenna 1 described above. The chip antenna 1 is manufactured through (a) a punch-out pressing step, (b) a bending pressing step, (c) an injection molding step, and (d) a separation step in this order.

First, in the punch-out pressing step, a conductive plate is punched out with a punch-out pressing die set (not shown) so as to be formed into a predetermined shape. Specifically, as illustrated in part (a) of FIG. 7 and FIG. 8*a*, there is formed a two-dimensionally expanded form 10' corresponding to an in-plane expansion of the three-dimensional antenna pattern 10. In this embodiment, the two-dimensionally expanded form 10' comprises a plurality of two-dimensionally expanded forms 10' punched out while being arranged in a side-by-side array on a long-belt-like conductive plate (hoop member 30). Further, the plurality of two-dimensionally expanded forms 10' in the illustration are respectively formed of a plurality of conductive plates separated from each other, and the conductive plates are coupled to a frame 31 of the hoop member 30 through intermediation of respective bridges 32.

Figure 7:
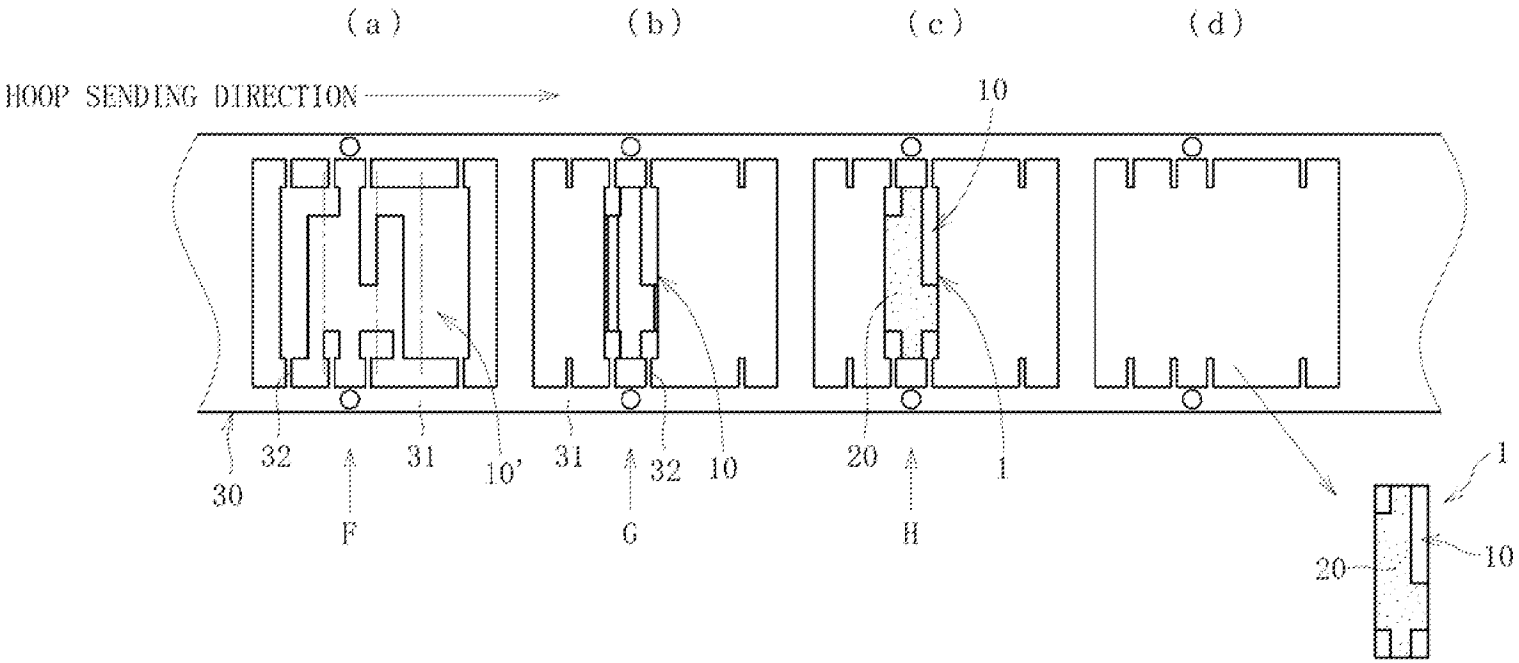
FIG. 7 A plan view illustrating a manufacturing method for the chip antenna according to the embodiment of the present invention.
Figure 8A:
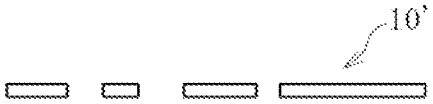
FIG. 8*a* A plan view in which a two-dimensionally expanded form of an antenna pattern provided to a hoop member is viewed in a direction F in part (a) of FIG. 7.
Figure 8B:
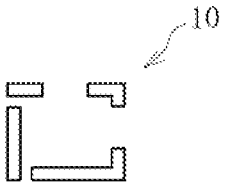
FIG. 8*b* A front view in which the antenna pattern bent into a three-dimensional shape is viewed in a direction G in part (b) of FIG. 7.

Next, the hoop member 30 is sent in a direction indicated by an arrow in FIG. 7 so that the two-dimensionally expanded form 10' is shifted to the bending pressing step. In the bending pressing step, the two-dimensionally expanded form 10' in the hoop member 30 is bent with a bending pressing die set (not shown). In this way, the antenna pattern 10 formed into a predetermined three-dimensional shape is obtained (refer to part (b) of FIG. 7 and FIG. 8*b*). This bending pressing step is performed under a state in which the two-dimensionally expanded form 10' remains fixed to the frame 31 of the hoop member 30 through intermediation of the bridge 32. At the time of bending the two-dimensionally expanded form 10', the two-dimensionally expanded form 10' and the bridge 32 are partially cut therebetween. However, the conductive plates separated from each other each remain coupled to the frame 31 through intermediation of the respective bridges 32 at least at one part. With this, even when the antenna pattern 10 comprises the plurality of conductive plates separated from each other, those conductive plates each can be integrally bent into a three-dimensional shape. Note that, the bending pressing step may be performed by a single press or a plurality of presses.

Figure 11A:
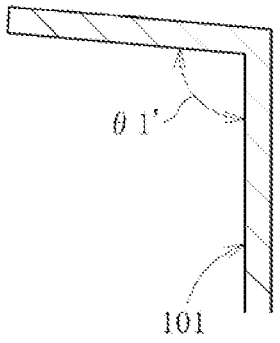
FIG. 11*a* A sectional view of a bent portion of the antenna pattern.
Figure 11B:
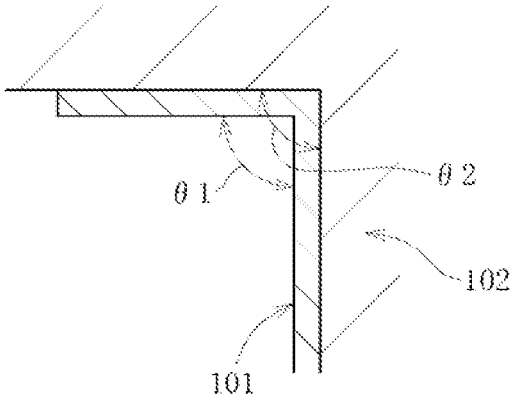
FIG. 11*b* A sectional view illustrating a state in which the antenna pattern of FIG. 11*a* is arranged in the injection molding die set.

Then, the hoop member 30 is further sent so that the antenna pattern 10 is shifted to the injection molding step. In the injection molding step, first, under a state in which the antenna pattern 10 is arranged as an insert component in a cavity of an injection molding die set (not shown), the injection molding die set is clamped. At this time, angles of the bent portions of the antenna pattern 10 supplied in the injection molding die set are set to be somewhat higher than angles of parts corresponding to the bent portions in the injection molding die set. This antenna pattern 10 is supplied into the injection molding die set and the injection molding die set is clamped. With this, the bent portions of the antenna pattern 10 are pressed by the injection molding die set, and hence the angles of the bent portions are corrected. In this way, the antenna pattern 10 can be held in close contact with the die set (refer to FIG. 11*b*).

Figure 8C:
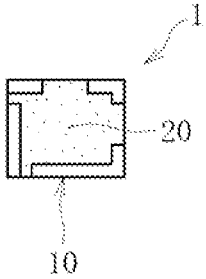
FIG. 8*c* A front view in which a chip antenna fixed to the hoop member is viewed in a direction H in part (c) of FIG. 7.

Next, in order to form the base 20, a resin is injected into the cavity in which the antenna pattern 10 is arranged (refer to part (c) of FIG. 7 and FIG. 8*c*). In this way, the chip antenna 1 comprising the antenna pattern 10 and the base 20 (indicated by a dotted pattern) integrated with each other is formed. When the injection molding die set is opened after the resin is cured, a force of pressing the bent portions of the antenna pattern 10 is released. Thus, the antenna pattern 10 is supposed to restore the original angle (refer to FIG. 11*a*). However, as described above in this embodiment, the flat plate portions 12 and 13 on both the sides of each of the bent portions 14 of the antenna pattern 10 are embedded in the base 20, and the projecting portions 15 provided at the edge portions 11*a* of the antenna pattern 10 are embedded in the base 20. Thus, the angles of the bent portions of the antenna pattern 10 are prevented from increasing, with the result that the three-dimensional shape of the antenna pattern 10 can be maintained.

Lastly, a molded product (chip antenna 1) is separated from the frame of the hoop member 30 (refer to part (d) of FIG. 7). After the injection molding step, the chip antenna 1 may be immediately separated from the hoop member 30, or the molded product may be rolled up once together with the hoop member 30. When the chip antenna 1 is rolled up together with the hoop member 30, the chip antenna 1 can be easily stored and conveyed. In addition, an alignment condition of the chip antennae 1 is maintained, and the chip antennae 1 are prevented from interfering with each other.

In the manufacturing steps described above, when the pressing with the bending pressing die set and the clamping of the injection molding die set are performed by the same drive unit, it is unnecessary to provide respective drive units for the die sets. Thus, a manufacturing apparatus can be simplified. Further, when the bending pressing process with the bending pressing die set and the clamping of the injection molding die set are simultaneously performed, a cycle time can be shortened.

The present invention is not limited to the embodiment described above. For example, in the bending pressing step described above, the bending operation may be performed in two phases. Alternatively, in order to further bend the conductive plate after the conductive plate is bent with the bending pressing die set, the conductive plate may be bent not only with a clamping force of the injection molding die set but also with a force of an additionally provided actuator (not shown). This actuator may be provided in or out of the bending pressing die set. As the actuator, for example, a pneumatic cylinder, a hydraulic cylinder, or a motor may be used.

Figure 9:
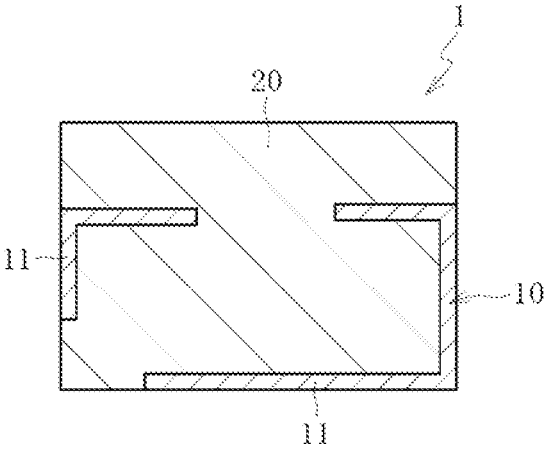
FIG. 9 A sectional view of a chip antenna according to another embodiment of the present invention.
Figure 10:
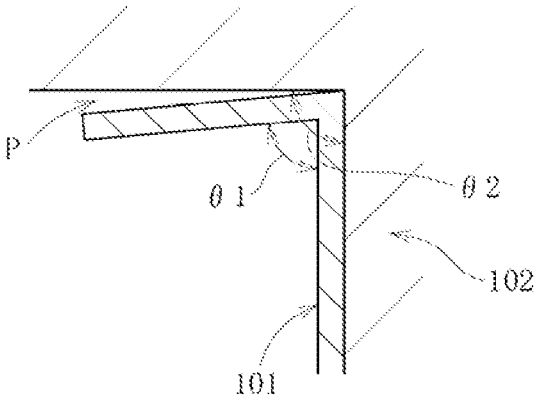
FIG. 10 A sectional view illustrating how a gap is formed between an antenna pattern and an injection molding die set.

Further, in the embodiment described above, the antenna pattern 10 is provided over the surfaces of the base 20. However, the present invention is not limited thereto. For example, as illustrated in FIG. 9, at least a part of the antenna pattern 10 may be embedded in the base 20.

Still further, the structure of the chip antenna 1 is not limited to that described above, and any structure may be employed as long as the antenna pattern 10 is formed into a three-dimensional shape. For example, the antenna pattern 10 is not limited to that described above, and various other structures may be employed.

REFERENCE SIGNS LIST

1 chip antenna
10 antenna pattern
10' two-dimensionally expanded form
11 conductive plate
12, 13 flat plate portion
14 bent portion
15 projecting portion
20 base
30 hoop member
31 frame
32 bridge

The invention claimed is:

1. A chip antenna, comprising:
an antenna pattern comprising a conductive plate bent into a three-dimensional shape; and
a base formed together with the antenna pattern as an insert component, the base being formed by injection molding of a resin,
wherein the antenna pattern is disposed at surfaces of the base,
wherein the antenna pattern comprises a bent portion and two flat plate portions provided respectively on both sides of the bent portion,
wherein both of the two flat plate portions of the antenna pattern are fixed to the base by the injection molding, and
wherein the antenna pattern further comprises an edge portion provided with a projecting portion which is embedded in the base, and the projecting portion is covered with the base from outside in a direction perpendicular to a first surface of the surfaces of the base, so as to prevent the two flat plate portions of the antenna pattern from rising from the surfaces of the base, and such that the projecting portion does not extend outside of the base.

2. A chip antenna according to claim 1, wherein the antenna pattern is held by the base so that the three-dimensional shape is maintained.

3. A chip antenna according to claim 1, wherein the resin of the base comprises a dielectric material having a dielectric constant of 4 or more.

4. A chip antenna according to claim 1, wherein a surface roughness of at least a surface of the antenna pattern, which is bonded to the base, is Ra 1.6 or more.

5. A chip antenna according to claim 1, further comprising:
a second conductive plate;
a third conductive plate; and
a fourth conductive plate,
wherein the conductive plate comprises a first corner of the insert component,
wherein the second conductive plate comprises a second corner of the insert component,
wherein the third conductive plate comprises a third corner of the insert component, and
wherein the fourth conductive plate comprises a fourth corner of the insert component.

6. A chip antenna according to claim 1, wherein the surfaces of the base are flush with outer surfaces of the antenna pattern.

7. A chip antenna according to claim 1, wherein the bent portion and the two flat plate portions comprise an outer corner of the insert component.

8. A chip antenna according to claim 1, wherein inner surfaces of the base different from the surfaces of the base are bound by a whole area of each of back surfaces and end surfaces of the two flat plate portions of the antenna pattern.

9. A chip antenna according to claim 1, wherein the projecting portion anchors the bent portion and the two flat plate portions with respect to the surfaces of the base.

10. A chip antenna, comprising:
an antenna pattern comprising a conductive plate bent into a three-dimensional shape; and
a base formed together with the antenna pattern as an insert component, the base being formed by injection molding of a resin,
wherein the antenna pattern is disposed at surfaces of the base,
wherein the antenna pattern comprises a bent portion and two flat plate portions provided respectively on both sides of the bent portion,
wherein a whole area of each of back surfaces and end surfaces of the two flat plate portions of the antenna pattern contacts the base directly, and
wherein the antenna pattern further comprises an edge portion provided with a projecting portion which is embedded in the base, and the projecting portion is covered with the base from outside in a direction perpendicular to a first surface of the surfaces of the base, so as to prevent the two flat plate portions of the antenna pattern from rising from the surfaces of the base, and such that the projecting portion does not extend outside of the base.

11. A chip antenna according to claim 10, further comprising:
a second conductive plate;
a third conductive plate; and
a fourth conductive plate,
wherein the conductive plate comprises a first corner of the insert component,
wherein the second conductive plate comprises a second corner of the insert component,
wherein the third conductive plate comprises a third corner of the insert component, and
wherein the fourth conductive plate comprises a fourth corner of the insert component.

12. A chip antenna according to claim 10, wherein the surfaces of the base are flush with outer surfaces of the antenna pattern.

13. A chip antenna according to claim 10, wherein the bent portion and the two flat plate portions comprise an outer corner of the insert component.

14. A chip antenna according to claim 10, wherein inner surfaces of the base different from the surfaces of the base are bound by the whole area of each of back surfaces and end surfaces of the two flat plate portions of the antenna pattern.

15. A manufacturing method for a chip antenna comprising a base made of a resin and a three-dimensional antenna pattern formed of a conductive plate, the manufacturing method for the chip antenna comprising:

a bending pressing step of bending the conductive plate so that the three-dimensional antenna pattern is formed; and an injection molding step of injection molding the base with the resin together with the three-dimensional antenna pattern as an insert component, wherein the three-dimensional antenna pattern is disposed at surfaces of the base, wherein the three-dimensional antenna pattern comprises a bent portion and two flat plate portions provided respectively on both sides of the bent portion, wherein both of the two flat plate portions of the three-dimensional antenna pattern are fixed to the base by the injection molding, and wherein the three-dimensional antenna pattern further comprises an edge portion provided with a projecting portion which is embedded in the base, and the projecting portion is covered with the base from outside in a direction perpendicular to a first surface of the surfaces of the base, so as to prevent the two flat plate portions of the three-dimensional antenna pattern from rising from the surfaces of the base, and such that the projecting portion does not extend outside of the base.

16. A manufacturing method for a chip antenna according to claim 15, wherein the conductive plate comprises a long-belt-like hoop member, and wherein the three-dimensional antenna pattern comprises a plurality of three-dimensional antenna patterns formed in the long-belt-like hoop member.

17. A manufacturing method for a chip antenna according to claim 15, further comprising clamping a die set for the injection molding step so that an angle of the bent portion of the three-dimensional antenna pattern is corrected, to thereby bring the bent portion of the three-dimensional antenna pattern and the die set for the injection molding step into close contact with each other.

18. A manufacturing method for a chip antenna according to claim 15, wherein the bending pressing step is performed by utilizing a clamping force of a die set for the injection molding step.

19. A manufacturing method for a chip antenna according to claim 15, wherein the bending pressing step is performed with both a clamping force of a die set for the injection molding step and a force of an additionally provided actuator.

20. A manufacturing method for a chip antenna according to claim 15, wherein the three-dimensional antenna pattern is formed by bending the conductive plate a plurality of times.

* * * * *